United States Patent [19]

Keller et al.

[11] Patent Number: 4,949,081

[45] Date of Patent: Aug. 14, 1990

[54] DATA DISPLAY DEVICE

[75] Inventors: Daniel R. Keller, St. Gallen, Switzerland; Andreas D. Schelling, Heerlen, Netherlands

[73] Assignee: U.S. Philips Corporation, New York, N.Y.

[21] Appl. No.: 282,148

[22] Filed: Dec. 9, 1988

Related U.S. Application Data

[63] Continuation of Ser. No. 68,504, Jun. 30, 1987, abandoned.

[30] Foreign Application Priority Data

Jul. 7, 1986 [NL] Netherlands ..... 8601759

[51] Int. Cl.[5] ..... G09G 3/04

[52] U.S. Cl. ..... 340/765; 340/756

[58] Field of Search ..... 340/756, 759, 763, 765, 340/774, 783, 784; 40/447, 448

[56] References Cited

U.S. PATENT DOCUMENTS

| | | | |
|---|---|---|---|
| 3,802,723 | 11/1972 | Borden, Jr. | 40/448 |
| 3,903,519 | 9/1975 | Zega | 40/448 |
| 3,936,816 | 2/1976 | Murata | 340/783 |
| 4,079,367 | 3/1978 | Yonezawa et al. | 340/756 |
| 4,237,459 | 12/1980 | Cordova | 340/756 |
| 4,342,031 | 7/1982 | Lapeyre | 340/756 |
| 4,412,214 | 10/1983 | Tanaka et al. | 340/765 |

*Primary Examiner*—Alvin Oberley
*Assistant Examiner*—Richard Hjerpe
*Attorney, Agent, or Firm*—Paul R. Miller

[57] ABSTRACT

A display screen for alpha-numerical information is divided into sub-segments in such a manner that 40 connections can suffice.

15 Claims, 4 Drawing Sheets

DATA DISPLAY DEVICE

Figure 1:
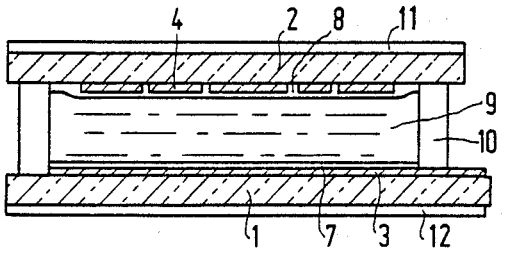

This is a continuation application Ser. No. 068,504, filed June 30, 1987, now abandoned.

The invention relates to a display device having at least a flat display screen, comprising an array of a plurality of substantially rectangular or parallelogram-shaped display elements in three columns.

In the present Application substantially rectangular may of course also be understood to mean square, while for example slight deviations such as roundings-off are possible.

Combinations of display devices of this type, notably for alpha-numerical data are used, for example, in information panels at airports, railway stations, banks, stadiums, etc.

A display device of the type mentioned in the opening paragraph is described in U.S. Pat. No. 3,936,816. The array shown in this Patent may relate to the positioning of (groups) of lamps or light-emitting diodes (LEDs). This array may be used particularly for sub-elements of gas discharge display devices or devices based on electro-luminescence. Use of these devices in conjunction with liquid crystalline material is also possible.

The characters to be displayed are formed by selectively driving parts of a matrix of 12 squares each being partitioned diagonally in four sub-segments. In this manner 48 sub-cells are obtained which can be driven individually.

When using such data displays the aim is to have arrays with a minimum possible number of connections. Notably in devices using a liquid crystal effect, an alpha-numerical character is often displayed by means of a 5×7-format dot matrix. However, oblique lines as well as those parts of the characters which by their origin have a round shape are generally displayed less satisfactorily. The latter characters usually give a somewhat angular impression, particularly in the slightly larger dimensions of the characters to be displayed (2–50 cm) which are conventional in the above-mentioned uses. Refinement and rounding-off by the use of, for example, a 7×9-format dot matrix leads to a considerable increase of the number of sub-segments and connections.

In order to avoid the above-mentioned drawbacks, a display device according to the invention is characterized in that the display elements are arranged in accordance with at least three rows, while each display element comprises at most 7 sub-segments.

The rows themselves may consist of a plurality of sub-rows. In this case such a sub-row need not always cross all three columns because the arrangement of display elements in one of the columns may not permit such a refinement. If the combination of a plurality of sub-rows forming one row is left outside consideration, an embodiment of a device according to the invention is characterized in that two columns each comprise 6 display elements and the third column comprises 4 display elements, the display elements in the two columns comprising at most 4 sub-segments and those in the third column comprising at most 5 sub-segments.

In a preferred embodiment the combined display elements comprise a total of 41 sub-segments, which yields an economy of more than 15% with respect to the device according to U.S. Pat. No. 3,936,816 and of almost 40% with respect to display elements based on 7×9 format dot matrixes.

Since an identical drive is formed to be sufficient for two sub-segments, in the preferred embodiment, the number of electric connections for the sub-segments may be reduced to 40, if this array is used to provide, for example, electrodes of a liquid crystal display device. Thus 41 electric connections are required in the case of direct drive in which only 1 counter electrode is contacted. A very large viewing angle may be realized over a large temperature range with this drive mode, which is extremely suitable for so-called guest-host LCD's.

On the other hand a plurality of counter electrodes may be used and may be driven by means of multiplexing, which decreases the number of required electric connections. In the case of 1:2 multiplexing, 22 connections may, for example, suffice (20 for the sub-segments+2 for the counter electrodes), in the case of 1:3 multiplexing even 17 connections are sufficient. Furthermore, standard IC's can be advantageously used in this case.

Figure 2:
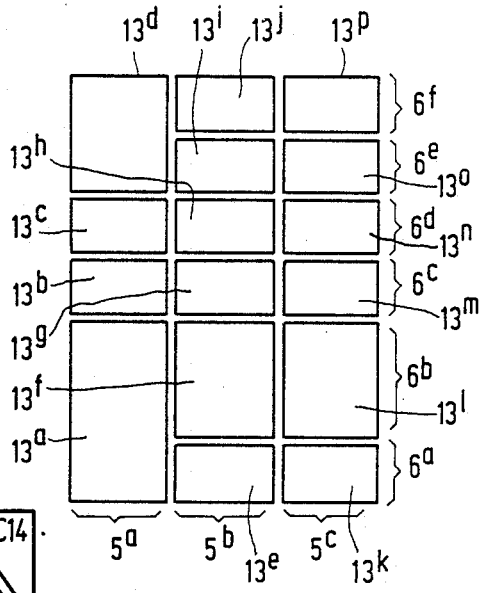
Figure 3:
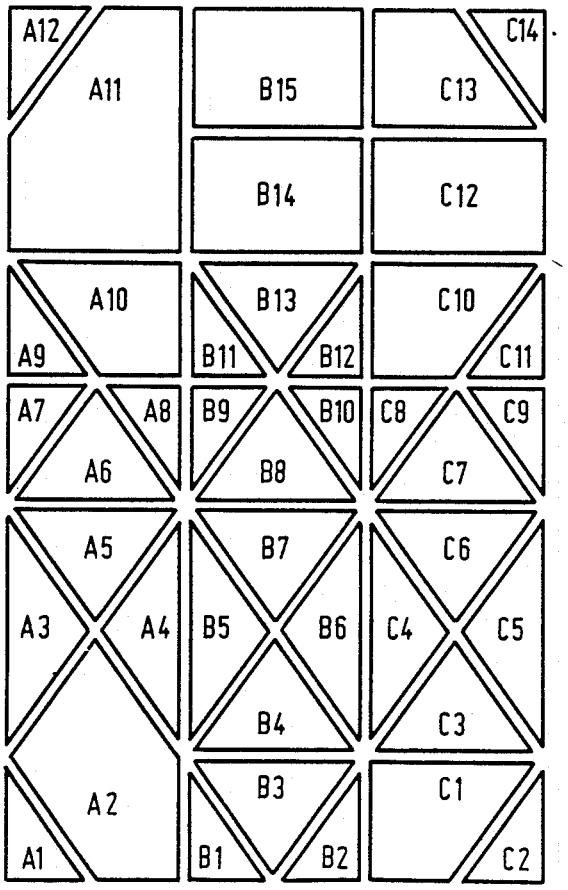
Figure 4:
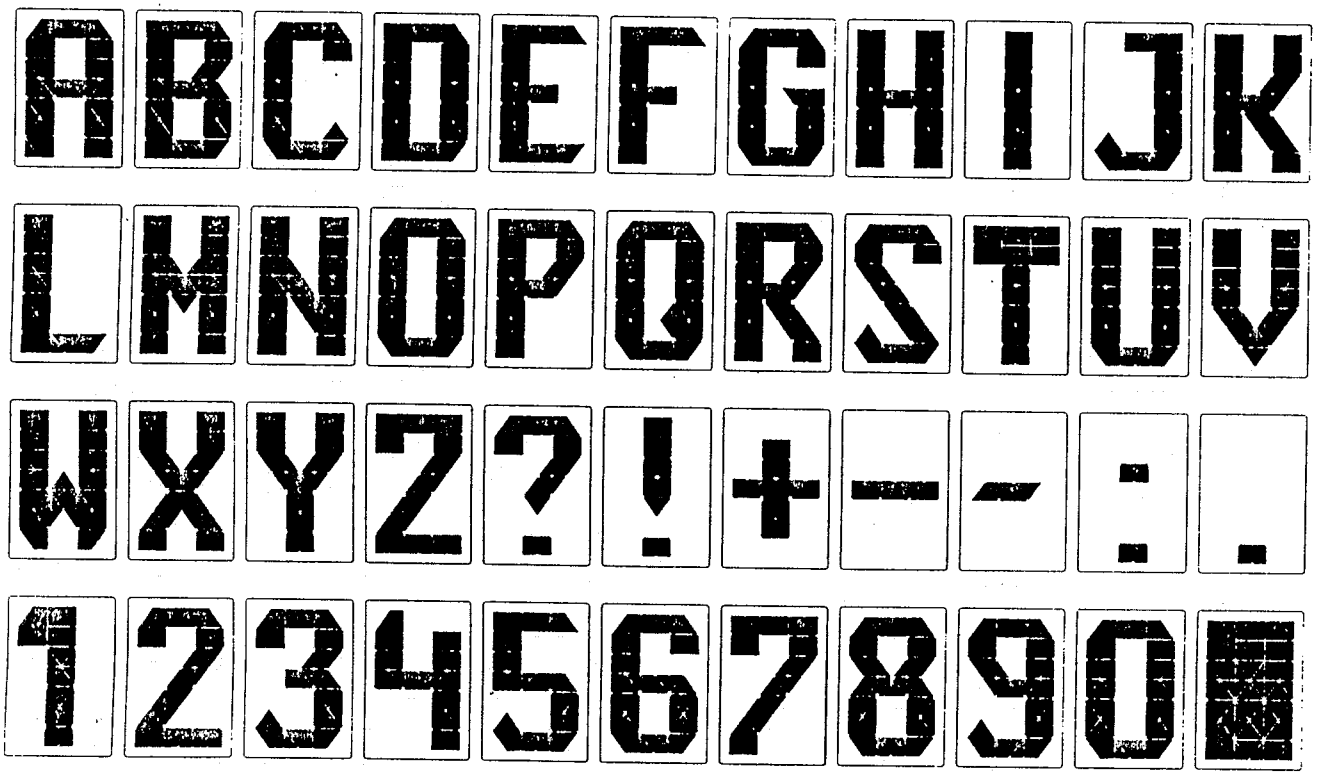
Figure 5:
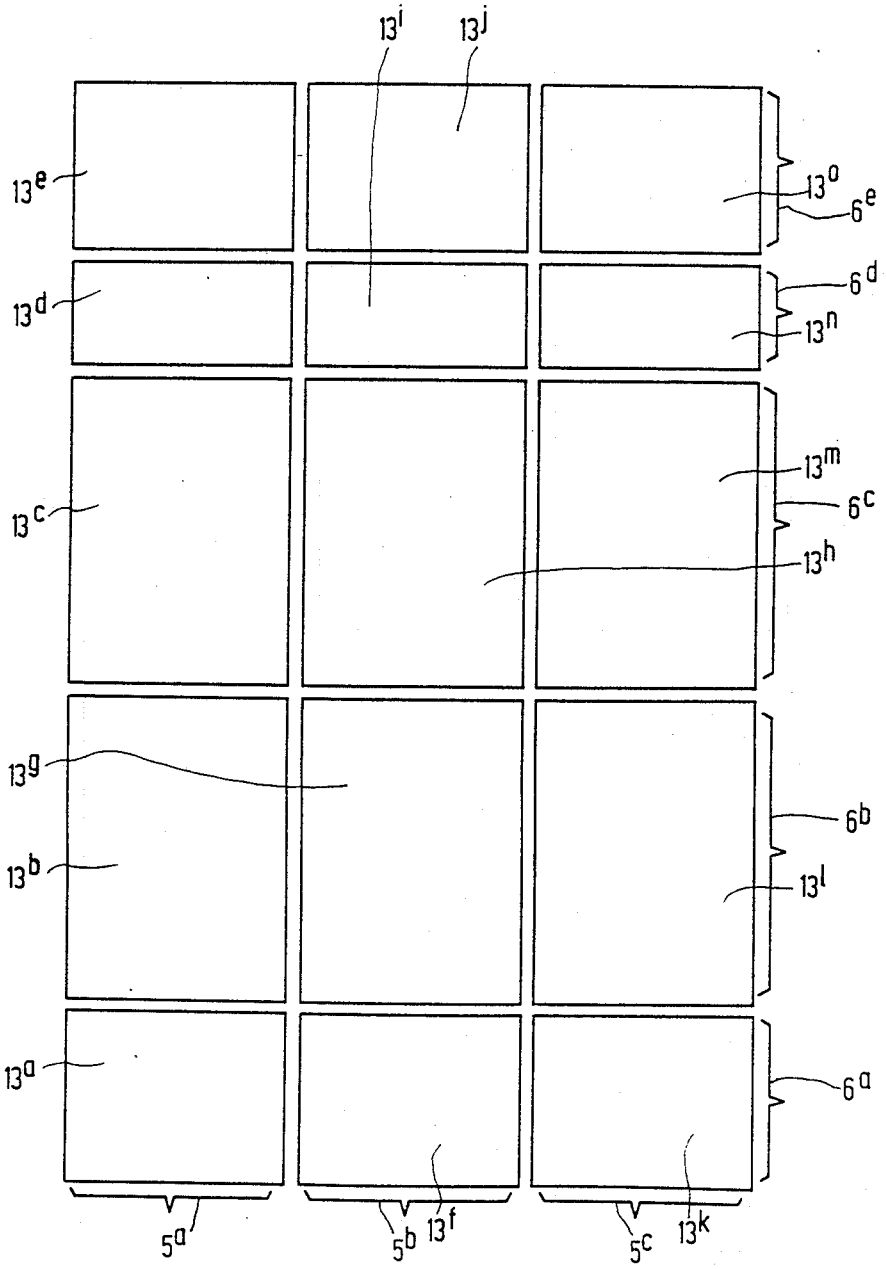

The invention will now be described in greater detail with reference to embodiments and the accompanying drawings in which FIG. 1 diagrammatically shows a liquid crystal device, FIG. 2 diagrammatically shows the planar arrangement of the display elements in a device according to the invention, FIG. 3 shows a detailed embodiment of FIG. 2 and FIG. 4 shows by way of example a number of alpha-numerical symbols which can be displayed with the device according to FIGS. 2, 3, and FIGS. 5 and 6 show embodiments of a variation of the division in sub-segments.

The liquid crystalline display device shown in FIG. 1 has two glass supporting plates 1 and 2 which are provided with electrodes 3 and 4 consisting of material conventionally used in LCD's. Orientation layers 7 and 8 are provided on the surfaces of the supporting plates 1 and 2 provided with electrodes. A liquid crystal material 9 is present between the supporting plates.

The gap between the plates 1 and 2 is several microns in this embodiment, which gap is maintained by spacing means not shown in the drawing which are regularly distributed over the surfaces of the plates. A sealing edge 10 connects the supporting plates at their circumference. In this embodiment each supporting plate is provided with a linear polariser, more specifically a polariser 11 and an analyser 12.

The electrode 3 may consist of a single electrode functioning as a counter electrode for all electrodes 4 which are provided in an array to be described hereinafter. In that case direct drive is used which produces a wide viewing angle and only a slight temperature-dependence of the display properties. This mode is particularly suitable for liquid crystals of the so-called guest-host type.

Driving may also be effected by means of multiplexing. In that case the electrode 3 is split up into, for example, 2 counter electrodes (1:2 multiplexing), 3 electrodes (1:3 multiplexing) or even more.

The counter electrodes 4 are arranged in accordance with rectangular display elements 13 (FIG. 2) which display elements are in turn arranged in columns 5*a*, 5*b*, 5*c*. As is shown in FIG. 2 the display elements 13 in the columns $5^b$, $5^c$ are arranged in turn in accordance with sub-rows $6^a$–$6^f$.

The array shown may, however, also be described as an array in accordance with 3 columns $5^a$, $5^b$, $5^c$ and 3 rows in which the sub-rows $6^a$, $6^b$ and the display element $13^a$ constitute a row of 3 display elements, namely $13^a$ and the display elements constituted by the combination of the display elements $13^e$ and $13^f$, and $13^k$ and $13^l$, respectively. Similarly the row formed by combination of the sub-rows $6^c$ and $6^d$ comprises three display elements, namely the combinations $13^b$, $13^c$ and $13^g$, $13^h$ and $13^m$ and $13^n$, respectively. Similarly the sub-rows $6^e$, $6^f$ with display element $13^d$ constitute the third row in which the other display elements are formed again by combinations of the display elements $13^i$ and $13^j$, and $13^o$ and $13^p$, respectively.

FIG. 3 shows how the display elements $13^a$–$13^p$ are divided into 41 sub-segments $A_1$–$A_{12}$, $B_1$–$B_{15}$ and $C_1$–$C_{14}$. If the width of a column 5 is referred to as b and the minimum height of a display element 13 (for example $13^b$) is referred to as h, then it holds that:

the display element $13^a$ of width b and height $3h$ has a sub-segment $A_1$ at the bottom left in the form of a right-angled triangle having sides h and $\frac{1}{2}b$ as legs, three sub-segments $A_3$, $A_4$, $A_5$ formed by three isosceles triangles with the apex angle in the center between the upright sides of element $13^a$ at a height $2h$ and as bases parts of the size $2h$ of the upright sides ($A_3$, $A_4$) and the lower side b ($A_5$), respectively, and a sub-segment $A_2$ formed by the remaining part of the display element $13^a$;

the display element $13^b$ of width b and height h comprises a sub-segment $A_6$ in the form of an isosceles triangle with the lower side of $13^b$ as a base and the apex angle halfway along the upper side, while the other triangular sub-segments $A_7$, $A_8$ are constituted by the remaining parts of the display element $13^b$;

the display element $13^c$ of width b and height h comprises a sub-segment $A_9$ at the bottom left in the form of a right-angled triangle having sides h and $\frac{1}{2}b$ as legs and a sub-segment $A_{10}$ formed by the remaining part of the display element $13^c$;

the display element $13^d$ of width b and height $2h$ comprises a sub-segment $A_{12}$ at the top left in the form of a right-angled triangle with sides h and $\frac{1}{2}b$ as legs and a sub-segment $A_{11}$ formed by the remaining part of the display element $13^d$;

the display element $13^e$ of width b and height h comprises a sub-segment $B_3$ in the form of an isosceles triangle with the upper side of $13^e$ as a base and the apex angle at the area of the center of the lower side, while the other triangular sub-segments $B_1$, $B_2$ are formed by the other parts of the display element $13^e$;

the display element $13^f$ of width b and height $2h$ has four triangular sub-segments $B_3$, $B_4$, $B_5$, $B_6$, $B_7$ obtained by dividing the rectangular display element in accordance with its diagonals;

the display element $13^g$ of width b and height h is identical to the display element $13^b$ and comprises sub-segments $B_8$, $B_9$, $B_{10}$;

the display element $13^h$ of width b and height h is identical to the display element $13^e$ and comprises sub-segments $B_{11}$, $B_{12}$, $B_{13}$;

the display element $13^i$ of width b and height h comprises a single segment $B_{14}$;

the display element $13^j$ of width b and height h comprises a single segment $B_{15}$;

the display element $13^k$ of width b and height h comprises a sub-segment $C_2$ at the bottom right in the form of a right-angled triangle having sides h and $\frac{1}{2}b$ as legs and a sub-segment $C_1$ formed by the remaining part of the display element $13^k$;

the display element $13^l$ of width b and height $2h$ is identical to the display element $13^f$ and comprises sub-segments $C_3$, $C_4$, $C_5$, $C_6$;

the display element $13^m$ of width b and height h is identical to the display element $13^g$ and comprises sub-segments $C_7$, $C_8$, $C_9$;

the display element $13^n$ of width b and height h is identical to the display element $13^k$ and comprises sub-segments $C_{10}$, $C_{11}$;

the display element $13^o$ of width b and height h comprises a single segment $C_{12}$;

the display element $13^p$ of width b and height h comprises a sub-segment $C_{14}$ at the top right in the form of a right-angled triangle having sides h and $\frac{1}{2}b$ as legs and a sub-segment $C_{13}$ formed by the remaining part of the display element $13^p$.

The different kinds of sub-segments thus described generally show little difference as far as their respective sizes are concerned. This is notably advantageous in smaller display devices because upon diminution the mutual distance between the sub-segments, in the case of large differences in size, would notably influence the visibility of smaller sub-segments in an unfavourable sense.

FIG. 4 shows how a number of alpha-numerical characters can be displayed with these 41 sub-segments. As is evident from FIG. 4, the sub-segments $B_1$ and $B_2$ are each time driven identically so that a single connection can suffice for these segments because they may be interconnected in an electrically conducting manner. In the case of direct drive (one sub-segment for each connection) 41 connections are then required (40 for the segments, 1 for the counter-electrode). In the case of 1:2 multiplexing a plurality of sub-segments (2 or 3) are driven via one connection, for example, the sub-segments associated with the display elements $13^a$, $13^b$, $13^e$, $13^f$, $13^k$, $13^l$ during the one half period and the other display elements are driven during the other half period. The counter electrode 3 is then split up in a corresponding manner and $20+2=22$ connections can suffice for the drive. In the case of 1:3 multiplexing the counter electrodes may, for example, correspond to the columns and 3 sub-segments may be interconnected in the direction of the row. In that case 17 connections can suffice.

In the above-mentioned embodiment the invention has been described with reference to a liquid crystal display device. Different types of materials may be chosen as the liquid crystal material such as nematic, cholesteric, chiral-nematic and ferro-electric materials or liquid crystal devices based on double refraction.

The invention has been explained with reference to a display screen for one character. In practice a plurality of these flat display screens will be placed side by side, for example, between 8 and 500 for the uses mentioned in the opening paragraph.

Several variations are possible within the scope of the invention. Instead of the device shown, which operates in the transmission mode, a device may be alternatively chosen which is operated in the reflection mode. To this end the device is provided with a mirror or a mirror surface at the area of the polariser 11.

Variations in the split-up of the elements into sub-segments and in the mutual dimensions are also possible. For example, for the sub-segments $A_{12}$, $B_{15}$, $C_{13}$ and $C_{14}$ a height slightly different from h may be chosen from an esthetical point of view. The display element $13^d$ may be split up in such a manner that it contains elements similar to the elements $13^o$, $13^p$. The elements $13^d$ may simultaneously have a substantially identical division as $13^h$, while still a drive with 41 connections remains possible, for example, by driving the sub-segments $A_7$, $A_9$ and $C_9$, $C_{11}$ simultaneously or by combining them to one sub-segment.

In that case (see FIG. 5) the display device may be described as an array in three columns 5a, 5b, 5c in which the display elements 13 are arranged in accordance with 5 rows 6a–6e and in which a display element in the central column comprises at most 6 sub-segments and a display element in the outer columns comprises at most 4 sub-segments.

Figure 6:
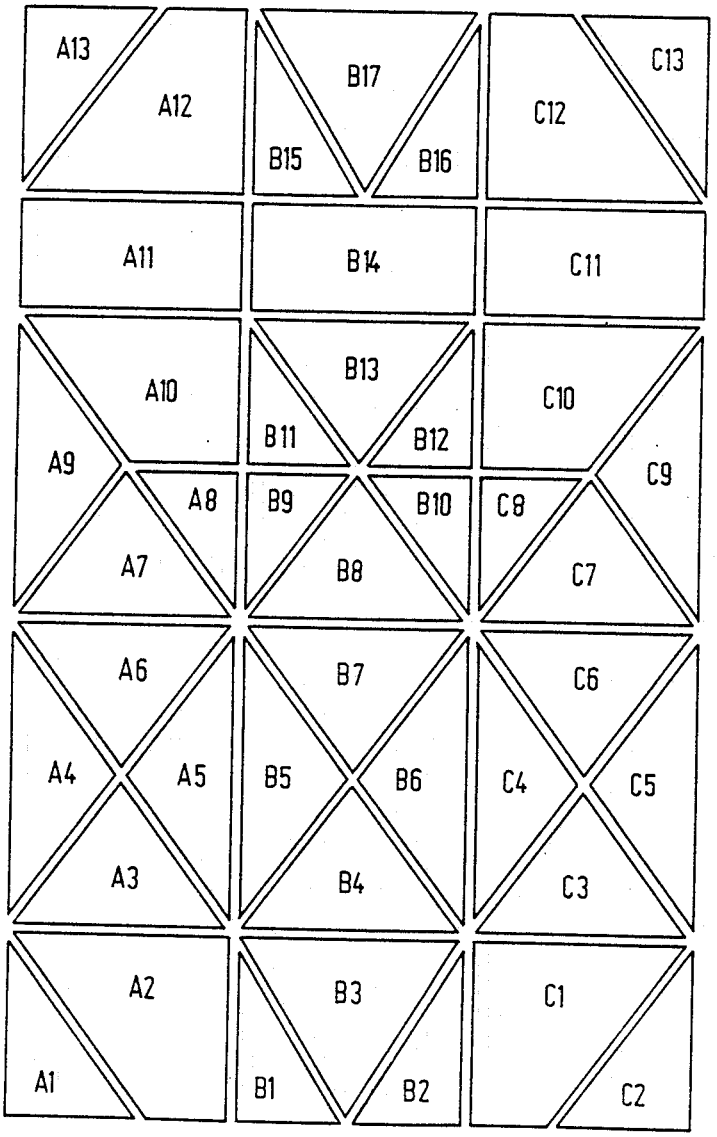

FIG. 6 shows how the display elements $13^a$–$13^o$ are divided in this case into 43 sub-segments $A_1$–$A_{13}$, $B_1$–$B_{17}$ and $C_1$–$C_{13}$. If the width of a column 5 is referred to as b and the minimum height of a display element 13 (for example $13^d$) is referred to as h, then it holds that:

the display element $13^a$ of width b and height 1.5h has a sub-segment $A_1$ at the bottom left in the form of a right-angled triangle having sides 1.5h and ½b as legs, and a sub-segment $A_2$ formed by the remaining part of the display element $13^a$;

the display element $13^b$ of width b and height 3h comprises four triangular sub-segments $A_3$, $A_4$, $A_5$, $A_6$ obtained by dividing the rectangular display element in accordance with its diagonals;

the display element $13^c$ of width b and height 3h comprises a sub-segment $A_7$ in the form of an isosceles triangle with the lower side of $13^c$ as a base and the apex angle in the center of the element $13^c$, at the bottom right a sub-segment $A_8$ in the form of a right-angled triangle having sides 3/2h and ½b as legs, on the left-hand side a sub-segment $A_9$ in the form of an isosceles triangle with the left-hand side as a base and the apex angle in the center of the display element $13^c$ and a sub-segment $A_{10}$ formed by the remaining part of the display element $13^c$;

the display element $13^d$ of width b and height h comprises a single sub-segment $A_{11}$;

the display element $13^e$ of width b and height 1.5h comprises a sub-segment $A_{13}$ at the top left in the form of a right-angled triangle with sides 1.5h and ½b as legs and a sub-segment $A_{12}$ formed by the remaining part of the display element $13^e$;

the display element $13^f$ of width b and height 1.5h comprises a sub-segment $B_3$ in the form of isosceles triangle with the upper side of $13^e$ as a base and the apex angle at the area of the center of the lower side, while the other triangular sub-segments $B_1$, $B_2$ are formed by the other parts of the display element $13^e$;

the display element $13^g$ of width b and height 3h has four triangular sub-segments $B_4$, $B_5$, $B_6$, $B_7$ obtained by dividing the rectangular display element in accordance with its diagonals;

the display element $13^h$ of width b and height 3h comprises sub-segments $B_8$, $B_9$, $B_{10}$, $B_{11}$, $B_{12}$, $B_{13}$ obtained by dividing the segment in accordance with its diagonals and a line through the center dividing the segments into a lower half and an upper half;

the display element $13^i$ of width b and height h comprises a single segment $B_{14}$;

the display element $13^j$ of width b and height 1.5h is divided identically as the display element $13^f$ into segments $B_{15}$, $B_{16}$, $B_{17}$;

the display element $13^k$ of width b and height 1.5h comprises a sub-segment $C_2$ at the bottom right in the form of a right-angled triangle having sides 1.5h and ½b as legs and a sub-segment $C_1$ formed by the remaining part of the display element $13^k$;

the display element $13^l$ of width b and height 3h is identical to the display element $13^g$ and comprises sub-segments $C_3$, $C_4$, $C_5$, $C_6$;

the display element $13^m$ of width b and height 3h is identical to the display element $13^c$ but mirrored with respect to the column direction and comprises sub-segments $C_7$, $C_8$, $C_9$, $C_{10}$;

the display element $13^n$ of width b and height h comprises a single element $C_{11}$;

the display element $13^o$ of width b and height 1.5h comprises a sub-segment $C_{13}$ at the top right in the form of a right-angled triangle having sides 1.5h and ½b as legs and a sub-segment $C_{14}$ formed by the remaining part of the display element $13^o$.

The elements may also be manufactured at an angle in the form of parallelograms by having the upright sides form an angle different from 90° with the horizontal sides, starting from the sub-segments described. The corners may also be slightly rounded off from an esthetical point of view.

Other display principles may also be used. To the planar array shown is, for example, also usable in gas discharge display devices or devices based on (electro-) luminescence, electrophoresis or devices based on electrochromic effects, thermo-optical or magneto-optical effects.

What is claimed is:

1. A display device having at least one flat display screen, said display device comprising an array of a plurality of substantially rectangular or parallelogram-shaped display elements, said display elements being arranged in three columns, and said display elements being arranged in at least three rows, wherein each of said display elements includes at most 7 sub-segments, said sub-segments being of varying different geometric shapes and sizes to form different respective display elements, and wherein said display elements include a combined total of 41 or 43 of said sub-segments.

2. A display device according to claim 1, wherein each of two of said three columns include 6 display elements and a third of said three columns includes 4 display elements, and wherein each of said display elements in said two of said three columns include at most 4 of said sub-segments and each of said display elements in said third of said three columns includes at most 5 of said sub-segments.

3. A display device according to claim 1 or claim 2, wherein said display elements include a combined total of 41 of said sub-segments.

4. A display device according to claim 3, wherein said display elements are practically rectangular, and wherein when viewed in a direction of the display screen in a normal position, (A) a left hand column from bottom to top consists of:

(I) a first display element including said sub-segments having (a) at the bottom left a right-angled triangle with half the lower side of a rectangle and one third of the left-hand side of said rectangle, (b) three substantially isosceles triangles, each having an apex angle substantially at the center between two upright sides of said rectangle at a distance of substantially one third of the upright side from the center of the upper side of said rectangle, and as bases the upper side and the upper parts of said upright sides of said rectangle having a length of substantially ⅔ of said upright sides, respectively, (c) the remaining part of said rectangle, (II) a second display element including sub-segments having (a) a substantially isosceles triangle having an apex angle approximately at the center of the upper side of a second rectangle and having a base being the lower side of said second rectangle, (b) two remaining triangles at opposite sides of said isosceles triangle of said second display element and having legs at said upper side and opposite upright sides of said second rectangle, (III) a third display element including sub-segments having (a) a substantially right-angled triangle having the left hand side and substantially half the lower side of a third rectangle for legs, (b) the remaining part of said third rectangle, (IV) a fourth display element including sub-segments having (a) at the top left corner of a fourth rectangle a substantially right angled triangle having legs constituting half the left hand upright side of said fourth rectangle and half the upper side of said fourth rectangle, (b) the remaining part of said fourth rectangle;

(B) a central column from bottom to top consists of:

(I) a fifth display element including sub-segments having (a) a substantially isosceles triangle having an apex angle approximately at the center of a lower side of a fifth rectangle, and having a base extending along the upper side of said fifth rectangle, (b) two other triangles at opposite sides of said substantially isosceles triangle of said fifth display element, said two other triangles forming remaining portions of said fifth rectangle, (II) a sixth display element including sub-segments being four triangles obtained by diagonals of a sixth rectangle, (III) a seventh display element being substantially identical to said second display element in said left hand column, (IV) an eighth display element being substantially identical to said fifth display element in said central column, (V) a ninth display element being substantially a rectangular shape, (VI) a tenth display element being substantially a second rectangular shape; and (C) a right hand column from bottom to top consists of:

(I) an eleventh display element including sub-segments having (a) at the lower right corner of a seventh rectangle a right angled triangle having legs constituted by the right hand upright side and substantially half the lower side of said seventh rectangle, (b) the remaining portion of said seventh rectangle, (II) a twelfth display element being substantially identical to said sixth display element in said central column, (III) a thirteenth display element being substantially identical to said second display element in said left hand column, (IV) a fourteenth display element being substantially identical to said eleventh display element in said right hand column, (V) a fifteenth display element being substantially identical to said ninth display element in said central column, (VI) a sixteenth display element including sub-segments having (a) at the top right of an eighth rectangle a right angled triangle having legs constituted by the right hand side and substantially half of the upper side of said eighth rectangle, (b) the remaining portion of said eighth rectangle.

5. A display device according to claim 4, wherein said columns have substantially identical widths, wherein said second, third, fifth, seventh, eighth, ninth, tenth, eleventh, thirteenth, fourteenth, fifteenth, and sixteenth display elements have a substantially identical height of h, wherein said fourth, sixth, and twelfth display elements have a substantially identical height of $2h$, and wherein said first display element has a height of approximately $3h$.

6. A display element according to claim 4, wherein said sub-segments are obtained from display elements in the form of parallelograms.

7. A display device according to claim 1, wherein said three columns include 5 display elements each, wherein a display element in the central column includes at most 6 sub-segments, and wherein at least one display element in at least one outer column includes at most 4 sub-segments.

8. A display device according to claim 1 or claim 7, wherein said display elements include a combined total of 43 of said sub-segments.

9. A display device according to claim 8, wherein when viewed in a direction of the display screen in a normal position, (A) a left hand column from bottom to top consists of:

(I) a first display element including sub-segments having (a) at the bottom left corner a right angled triangle having the left hand upright side of a first rectangle as one leg and having half of the lower side of said first rectangle as another leg, (b) the remaining portion of said first rectangle, (II) a second display element including sub-segments being four triangles obtained by diagonals of a second rectangle, (III) a third display element including sub-segments having (a) at the lower right of a third rectangle a right angled triangle having one leg extending for half the right hand side of said third rectangle and having a second leg extending horizontally from said right hand side to a center of said third rectangle, (b) two substantially isosceles triangles having apex angles at said center and bases being the lower side of said third rectangle and the left hand side of said third rectangle, (c) the remaining portion of said third rectangle, (IV) a fourth display element having a substantially rectangular shape, (V) a fifth display element including sub-segments having (a) a right angled triangle having a leg constituting the left hand side of fourth rectangle and a leg constituting substantially half the upper side of said fourth rectangle, (b) the remaining portion of said fourth rectangle, (B) a central column from bottom to top consists of:

(I) a sixth display element including sub-segments having (a) a substantially isosceles triangle having an apex angle approximately in the center of the lower side of a fifth rectangle and a base being the upper side of said fifth rectangle, (b) two other triangles at opposite sides of said substantially isosceles triangle of said sixth display element, said two other triangles forming remaining portions of said fifth rectangle, (II) a seventh display element including the sub-segments of four triangles obtained by diagonals of a sixth rectangle, (III) a eighth display element including the sub-segments of six triangles obtained by diagonals of a seventh rectangle and a horizontal line from side to side through the center of said seventh rectangle, (IV) a ninth display element having a substantially rectangular shape, (V) a tenth display element being substantially identical to said sixth display element in said central column, and (C) a right hand column from bottom to top consists of:

(I) an eleventh display element including sub-segments having (a) at the bottom right corner a right angled triangle having legs constituted by the right hand upright side and substantially half the lower side of an eighth rectangle, (b) the remaining portion of said eighth rectangle, (II) a twelfth display element being substantially identical to said second display element in said left hand column, (III) a thirteenth display element being a mirror image in the horizontal direction of said third display element in said left hand column, (IV) a fourteenth display element having a substantially rectangular shape, (V) a fifteenth display element including sub-segments having (a) at the top right corner of a ninth rectangle a right angled triangle having legs constituted by the right hand upright side and substantially half of the upper side of said ninth rectangle, (b) the remaining portion of said ninth rectangle.

10. A display device according to claim 9, wherein said columns have a substantially identical width, wherein said fourth, ninth, and fourteenth display elements have a substantially identical height of h, wherein said first, fifth, sixth, tenth, eleventh, and fifteenth display elements have a substantially identical height of approximately 1.5*h*, and wherein said second, third, seventh, eighth, twelfth, and thirteenth display elements have a substantially identical height of approximately 3*h*.

11. A display element according to claim 9, wherein said sub-segments are obtained from display elements in the form of parallelograms.

12. A display device according to claim 1 or claim 2 or claim 7, wherein said sub-segments are defined by transparent electrodes, and wherein said display screen has at least one counter electrode.

13. A display device according to claim 12, wherein a liquid crystalline material is disposed between said transparent electrodes and said at least one counter electrode.

14. A display device according to claim 1 or claim 2 or claim 7, wherein said display screen has a height of at least 2 cm and at most 10 cm.

15. A display device according to claim 1 or claim 2 or claim 7, wherein at least 8 and at most 500 display screens are disposed side by side.

* * * * *